US006572524B1

(12) United States Patent
Caldwell

(10) Patent No.: US 6,572,524 B1
(45) Date of Patent: Jun. 3, 2003

(54) DECANTER CENTRIFUGE HAVING A HEAVY PHASE SOLIDS BAFFLE

(75) Inventor: John W. Caldwell, Glenside, PA (US)

(73) Assignee: Alfa Laval Inc., Warminster, PA (US)

( * ) Notice: Subject to any disclaimer, the term of this patent is extended or adjusted under 35 U.S.C. 154(b) by 0 days.

(21) Appl. No.: 09/616,443

(22) Filed: Jul. 14, 2000

(51) Int. Cl.[7] ..... B04B 1/20
(52) U.S. Cl. ..... 494/53
(58) Field of Search ..... 494/50–55; 210/380.1, 210/380.3

(56) References Cited

U.S. PATENT DOCUMENTS

| | | | | |
|---|---|---|---|---|
| 832,191 | A | | 10/1906 | Holzer |
| 1,230,560 | A | | 6/1917 | Camp |
| 1,572,299 | A | | 2/1926 | McEntire |
| 1,614,357 | A | | 1/1927 | Gamper |
| 1,756,194 | A | | 4/1930 | Haug |
| 1,927,822 | A | | 9/1933 | Coe |
| 2,044,996 | A | | 6/1936 | Podbielniak |
| 2,174,857 | A | | 10/1939 | Vogel-Jorgensen |
| 2,313,540 | A | | 3/1943 | Hall |
| 2,435,623 | A | | 1/1948 | Forsberg |
| 2,495,950 | A | | 1/1950 | Van Der Werff |
| 2,578,456 | A | | 12/1951 | Smith |
| 2,622,794 | A | * | 12/1952 | Smith |
| 2,625,320 | A | * | 1/1953 | Lyons |
| 2,679,974 | A | | 6/1954 | Gooch |
| 2,740,580 | A | | 4/1956 | Schmiedel |
| 2,743,864 | A | | 5/1956 | Lyons |
| 2,766,930 | A | | 10/1956 | Schmiedel |
| 3,187,997 | A | * | 6/1965 | Gooch |
| 3,228,594 | A | | 1/1966 | Amero |
| 3,279,687 | A | | 10/1966 | Amero |
| 3,279,688 | A | | 10/1966 | Cook |
| 3,285,507 | A | | 11/1966 | Shapiro |
| 3,368,747 | A | | 2/1968 | Lavanchy et al. |
| 3,398,888 | A | | 8/1968 | Koenecke et al. |
| 3,405,866 | A | | 10/1968 | Amero |
| 3,447,742 | A | * | 6/1969 | Eriksson et al. |
| 3,623,656 | A | * | 11/1971 | Lavanchy |
| 3,782,623 | A | | 1/1974 | Bye-Jorgensen et al. |
| 3,795,361 | A | | 3/1974 | Lee |

(List continued on next page.)

FOREIGN PATENT DOCUMENTS

| | | | |
|---|---|---|---|
| DE | 29 07 318 | | 2/1979 |
| DE | 33 35 873 | | 10/1983 |
| DE | 3501341 | * | 7/1986 |

(List continued on next page.)

OTHER PUBLICATIONS

English translation of JP 09–201550.
English translation of JP 10–151369.
English ranslation of DE 37 23 864.

*Primary Examiner*—Charles E. Cooley
(74) *Attorney, Agent, or Firm*—Drinker Biddle & Reath LLP

(57) ABSTRACT

A decanter centrifuge is defined for separating a heavy phase material from a liquid within a feed mixture. The decanter centrifuge includes a bowl rotatable about its longitudinal axis for separation of the heavy phase material from the liquid feed mixture due to centrifugal force. The bowl typically includes a cylindrical portion and a frusto-conical portion at one end. A solids discharge is provided in the restricted end of the frusto-conical bowl portion. A screw conveyor is coaxially mounted for rotation within the bowl, having a spiraled conveyor flight extending radially outwardly to a position adjacent the inside wall of the bowl. The conveyor is adapted to rotate at a relative speed with respect to the bowl for conveying separated heavy phase material toward the heavy phase discharge. A baffle in the form of a disc extends radially outwardly from the conveyor hub and is adapted to project into the separated heavy phase material being conveyed along the bowl wall. A shelf is positioned between the disc and a forward or conveying portion of the conveyor flight. The shelf substantially forms an included angle with a radially extending line that is greater than 45 degrees and preferably has an outwardly facing convex surface.

26 Claims, 5 Drawing Sheets

U.S. PATENT DOCUMENTS

| | | | | | |
|---|---|---|---|---|---|
| 3,885,734 | A | | 5/1975 | Lee | |
| 3,934,792 | A | * | 1/1976 | High et al. | |
| 4,142,669 | A | | 3/1979 | Burlet | |
| 4,186,097 | A | | 1/1980 | Dudley et al. | |
| 4,209,128 | A | | 6/1980 | Lyons | |
| 4,245,777 | A | * | 1/1981 | Lavanchy | |
| 4,298,160 | A | | 11/1981 | Jackson | |
| 4,332,350 | A | | 6/1982 | McClellan | |
| 4,339,072 | A | | 7/1982 | Hiller | |
| 4,378,906 | A | * | 4/1983 | Epper et al. | |
| 4,449,967 | A | * | 5/1984 | Caldwell | |
| 4,566,873 | A | | 1/1986 | Toda | 494/53 |
| 4,617,010 | A | | 10/1986 | Epper et al. | 494/52 |
| 4,654,022 | A | * | 3/1987 | Shapiro | |
| 4,714,456 | A | * | 12/1987 | Bender et al. | |
| 4,731,182 | A | | 3/1988 | High | |
| 4,743,226 | A | | 5/1988 | Day et al. | |
| 4,826,608 | A | | 5/1989 | Kopper | |
| 4,828,541 | A | | 5/1989 | Madsen | 494/53 |
| 4,915,681 | A | * | 4/1990 | Suzuki | |
| 5,147,277 | A | | 9/1992 | Shapiro | 494/53 |
| 5,156,751 | A | * | 10/1992 | Miller | |
| 5,182,020 | A | | 1/1993 | Grimwood | |
| 5,252,209 | A | * | 10/1993 | Retter | |
| 5,261,869 | A | * | 11/1993 | Caldwell et al. | |
| 5,306,225 | A | * | 4/1994 | Miyano et al. | |
| 5,342,281 | A | * | 8/1994 | Unkelbach et al. | |
| 5,354,255 | A | | 10/1994 | Shapiro | 494/53 |
| 5,509,882 | A | * | 4/1996 | Caldwell | |
| 5,584,791 | A | * | 12/1996 | Grimwood et al. | |
| 5,643,169 | A | * | 7/1997 | Leung et al. | |
| 5,653,673 | A | * | 8/1997 | Desai et al. | |
| 5,653,674 | A | * | 8/1997 | Leung | |
| 5,695,442 | A | * | 12/1997 | Leung et al. | |
| 5,840,007 | A | * | 11/1998 | Leung et al. | |
| 5,948,256 | A | * | 9/1999 | Leung | |
| 6,024,686 | A | * | 2/2000 | Madsen | |
| 6,110,096 | A | * | 8/2000 | Leung et al. | |

FOREIGN PATENT DOCUMENTS

| | | | |
|---|---|---|---|
| DE | 37 23 864 | | 1/1989 |
| DE | 4119003 | * | 12/1992 |
| DK | 64505 | | 5/1946 |
| EP | 0 348 213 A2 | | 6/1989 |
| EP | 488086 | * | 6/1992 |
| FR | 384326 | | 4/1908 |
| FR | 1271244 | | 7/1960 |
| FR | 1 401 528 | | 4/1965 |
| GB | 456353 | * | 11/1936 |
| GB | 2148750 | * | 6/1985 |
| IT | 453726 | | 4/1949 |
| JP | 56-021655 A | | 2/1981 |
| JP | 2-40248 | * | 2/1990 |
| JP | 3-238058 | * | 10/1991 |
| JP | 09-201550 A | | 8/1997 |
| JP | 10-151369 A | | 6/1998 |
| SU | 1174088 | * | 8/1985 |

* cited by examiner

DECANTER CENTRIFUGE HAVING A HEAVY PHASE SOLIDS BAFFLE

FIELD OF THE INVENTION

The present invention relates to centrifuges and particularly to decanter type centrifuges. The invention is specifically directed toward a centrifuge having a baffle or the like which acts as a dam to restrict solids passing towards discharge.

BACKGROUND OF THE INVENTION

A decanter-type centrifuge comprises a rotating bowl, typically having a cylindrical portion and a frusto-conical end portion which are substantially imperforate. The rotation of the bowl creates a centrifugal force which separates a liquid feed mixture into its constituent parts. The feed mixture within the bowl forms a cylindrical pond, with a ring or layer of separated heavy material adjacent the inside of the bowl wall and a ring or layer of lighter material radially inward of the heavy material layer.

The terms "heavy phase" and "light phase" are sometimes employed to describe the materials which are separated from the feed mixture by the application of centrifugal force. In a decanter centrifuge having a conveyor, the light phase material will usually be a liquid and the heavy phase material will usually be a mixture of solids and liquid. The liquid feed mixture or slurry introduced into the bowl generally has a specific concentration of suspended solids or other insoluble materials therein. These solids are concentrated by the centrifugal force to form within the rotating bowl a heavy phase, including coarse solids, fine solids and liquid.

In a decanter centrifuge, a coaxially mounted screw conveyor rotates inside the bowl at a slightly different speed from the bowl. The flights of the screw conveyor push the separated heavy phase along the inside of the bowl wall towards the frusto-conical end of the bowl. Discharge ports for the separated heavy phase are located at the relatively smaller diameter end of the frusto-conical bowl portion. The separated light phase liquid is discharged by flowing from the cylindrical pond through separate discharge opening or ports. The light phase liquid discharge ports are located, typically, at the opposite end of the bowl from the heavy phase discharge.

Separation of the heavy phase materials from the feed mixture is a function of the residence time of the mixture in the bowl, the feed rate, the difference in specific gravity of the solids of the heavy phase from the liquid of the light phase, and the ability of the centrifuge to separately discharge the heavy and light phase materials. The purpose of the decanter centrifuge is to separately discharge a concentrated heavy phase and a clarified liquid. In order for the heavy phase to be discharged, it must be moved up the incline of the inside surface of the frusto-conical end of the bowl, called the beach, against the centrifugal force component acting in the opposite direction, downward along the beach (away from the heavy phase discharge).

One form of decanter centrifuge is shown in U.S. Pat. No. 3,795,361 to Lee. The centrifuge includes a conveyor having a central conveyor hub and a spiraled conveyor flight extending for at least a portion of the longitudinal length of the bowl. A feed pipe extends along the axis of the conveyor terminating in a feed chamber within the conveyor hub. A feed mixture is introduced into the feed chamber via the feed pipe. The feed engages accelerator vanes for imparting radial and tangential velocity thereto. Once the feed is brought up to speed, it is discharged out of the feed chamber through feed passages and into the centrifuge bowl where separation occurs. The centrifuge includes a baffle or partition mounted on the conveyor hub. In one embodiment, the baffle is a radial disc mounted adjacent the joint between the cylindrical and frusto-conical portions of the bowl. In another embodiment, the baffle is a conical structure mounted within the frusto-conical portion of the bowl. The baffle, whether conical or a disc, extends radially from the conveyor hub and penetrates into the heavy phase solids layer to form an annular hydraulic seal. In addition, the radial position of the light phase discharge is positioned inward of the position of the heavy phase discharge. This relationship, in conjunction with the penetration of the baffle into the heavy phase layer, creates a centrifugal pressure head that assists in pushing the solids up the beach towards discharge. Lee U.S. Pat. No. 3,795,361 is herein incorporated by reference.

Variations on the use of a baffle and centrifugal pressure head to assist in solids discharge are known. For example, U.S. Pat. No. 3,934,792 to High et al. shows an axial baffle extending between two adjacent portions of the conveyor flight. Also, U.S. Pat. No. 5,354,255 to Shapiro discloses a decanter centrifuge including a radial baffle positioned adjacent an open feed chamber formed within a discontinuity in the conveyor hub. A plurality of vanes extend across the feed chamber to create structural integrity for the conveyor. A ribbon-type conveyor flight is provided in the separation portion of the bowl.

In positioning a baffle on a conveyor hub, there is created a confined area where the baffle meets the spiral of the conveyor flight. The solids rotate with the bowl and, because of the differential rotational speed of the conveyor, are propelled axially by the conveyor flight toward the heavy phase discharge ports at one end of the bowl. This movement also causes the heavy phase to be pushed or wedged into the confined area between the flight and the baffle, creating a solids jam which may bend the baffle and the flight and which may cause the conveyor to be out of balance.

SUMMARY OF THE INVENTION

The present invention relates particularly to a decanter-type centrifuge of the type having a bowl rotatable about its longitudinal axis and a coaxially mounted screw conveyor rotating at a relative speed with respect to the bowl. The screw conveyor includes a spiraled conveyor flight extending radially outwardly to a position adjacent the inside wall of the bowl for conveying separated heavy phase material toward the heavy phase discharge in the bowl. A baffle extends from the conveyor hub and is adapted to project into the separated heavy phase material. A shelf is positioned between the baffle and the forward or conveying portion of the conveyor flight to close the restricted area between the baffle and the conveyor flight.

In one embodiment of the present invention, the shelf forms an included angle with any radially extending line that is greater than 45 degrees, and preferably in the range of 60 to 75 degrees.

In another embodiment of the present invention, the shelf is curved and has an outwardly facing convex surface. Preferably, the curved shelf forms an included angle with a radially extending line that is greater than 45 degrees, and preferably in the range of 60 to 75 degrees.

In a still further embodiment of the present invention, the shelf forms the baffle by extending between adjacent portions of the conveyor flight. The shelf baffle is preferably curved and has an included angle greater than 45 degrees.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE DRAWINGS

Figure 1:
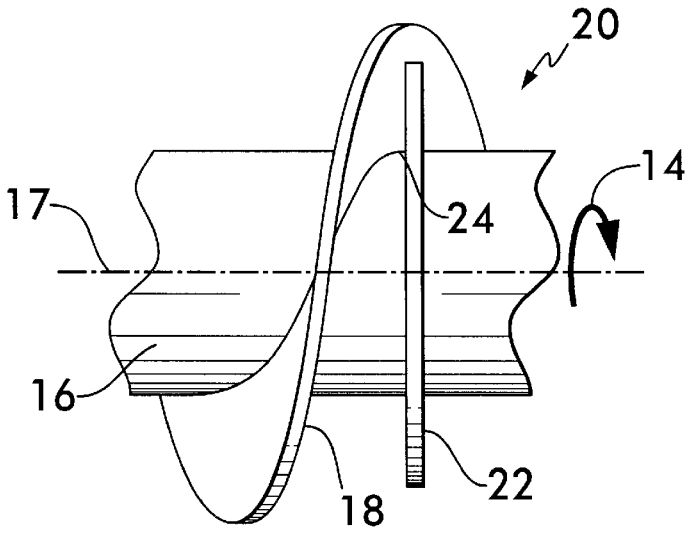
FIG.1 Prior Art
FIG. 1 illustrates a portion of a conveyor of a conventional decanter centrifuge having a heavy phase solids disc thereon

In the drawings, where like numerals indicate like elements, there is shown various embodiments of a decanter centrifuge. In FIG. 1, there is shown a portion of a conveyor of a prior art decanter centrifuge having a heavy phase solids disc in accordance with Lee U.S. Pat. No. 3,795,361. The screw conveyor 20 generally comprises a longitudinally-extending hub 16 which is mounted for rotation about its central longitudinal axis 17. The conveyor 20 is contemplated to be rotated in a clockwise direction when viewed from the right-hand end, see arrow 14. Extending from the conveyor hub 16 is a spiraled conveyor flight, a portion of which being shown and which is generally designated by the numeral 18. A disc-type baffle 22 extends radially from the conveyor hub 16 to a position radially inward of the radial periphery of the adjacent portion of the conveyor flight 18. For purposes of this discussion, the conveyor 20 is rotating as shown by arrow 14 with the bowl (not shown in this figure) rotating in the same direction but at a slightly greater speed than the conveyor 20. The disc 22 forms a restriction for the heavy phase solids being conveyed axially toward the solids discharge on the right (in FIG. 1).

Because the heavy phase solids generally ride with the bowl, they are moved into the wedge shaped space 24 between the front face of the spiraled conveyor flight 18 and the rear face of the disc 22. The joint between the conveyor and the disc forms a restriction to the continued advance of heavy phase material and a solids jam may occur in the wedged-shape space 24. This solids jam may force the disc 22 and the conveyor flight 18 away from each other, causing damage to both.

In addition, the solids which are jammed into the wedge space cannot be removed by typical clean-in-place type procedures. The jammed solids provide additional resistance to the solids which must go under the disc to move towards discharge. The solids moving towards discharge will experience a higher coefficient of friction against the jammed solids as compared to the metal of the disc. This results in further solids attaching to the jammed solids, and resistance to the desired action of the disc.

Figure 2:
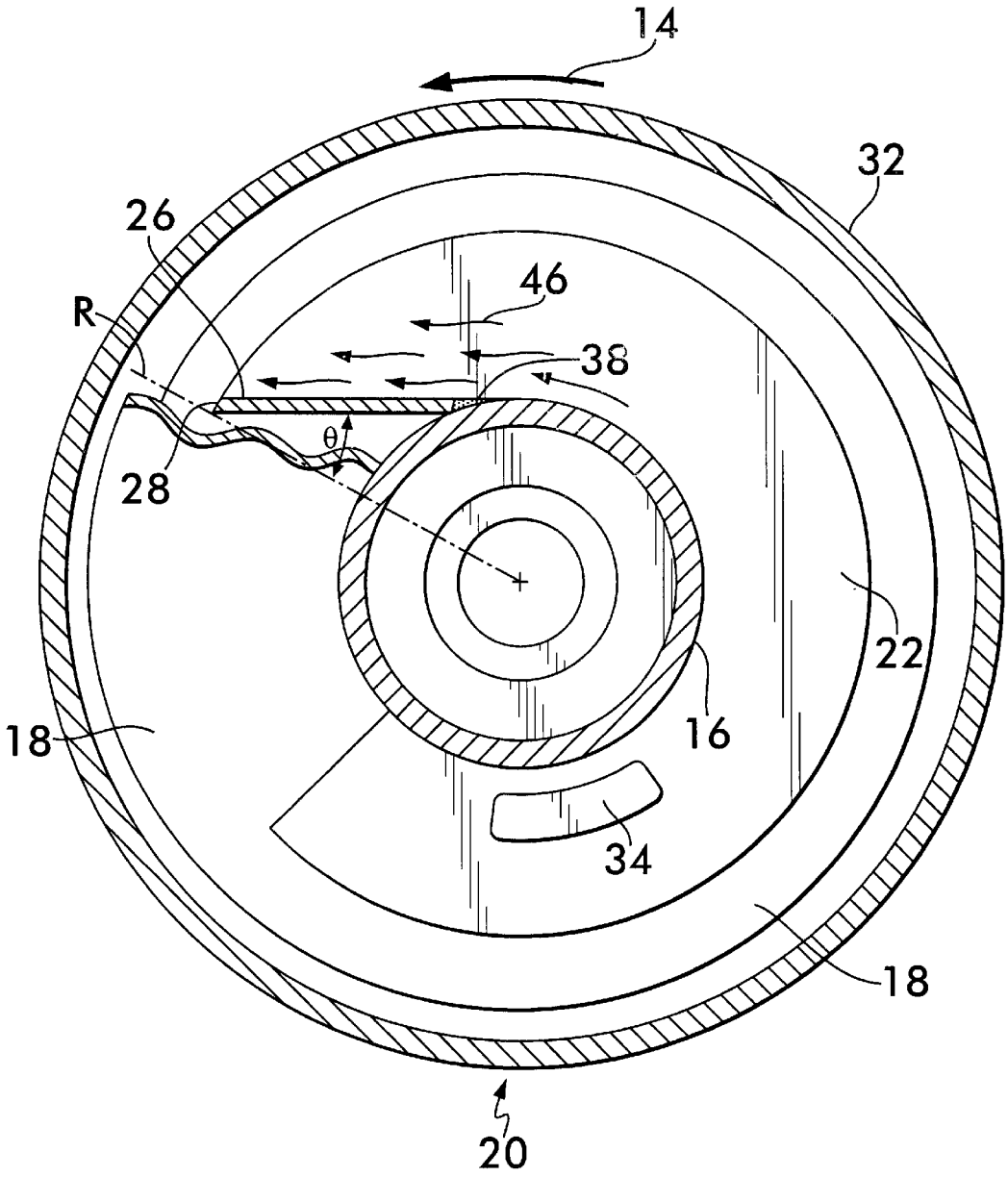
FIG.2 Prior Art
FIG. 2 is a partial cross-sectional view of a decanter centrifuge conveyor having a heavy phase solids baffle structure thereon.

Another embodiment of the prior technology is shown in FIG. 2. An elongated shelf 26 is provided extending from the conveyor hub 16 at the attachment 38 to a position adjacent the peripheral edge of the disc 22. The shelf 26 spans the gap between the rear face of the disc 22 and the front face of the conveyor flight 18. In order to assist in balancing the rotation of the conveyor 20, a counterweight 34 is provided on the face of the disc 22 substantially radially opposite the shelf. This shelf may be formed as a separate element which is welded into position or may result from an angled extension on the edge of the disc, which is bent axially to meet the front face of the conveyor flight. However, certain process disadvantages sometimes occur with this construction and the jam of solids may still occur.

The movement of the heavy phase solids material is generally in the direction of the conveyor rotation 14, as illustrated by arrows 46 in FIG. 2. As the solids approach the end of the disc 22, they are directed over and along the shelf 26. This permits the hydraulic seal to be completed by the disc and in some applications deters the jam of solids between the disc and the conveyor flight. In the known centrifuges of the type show in FIG. 2 and as discussed above, the angle θ between a radial line R and the shelf 26 is less than 35 degrees. In another known embodiment of the centrifuge, the shelf is provided with a radial inward portion having an angle of 70 degrees and a radial outer portion of about 35 degrees.

Figure 3:
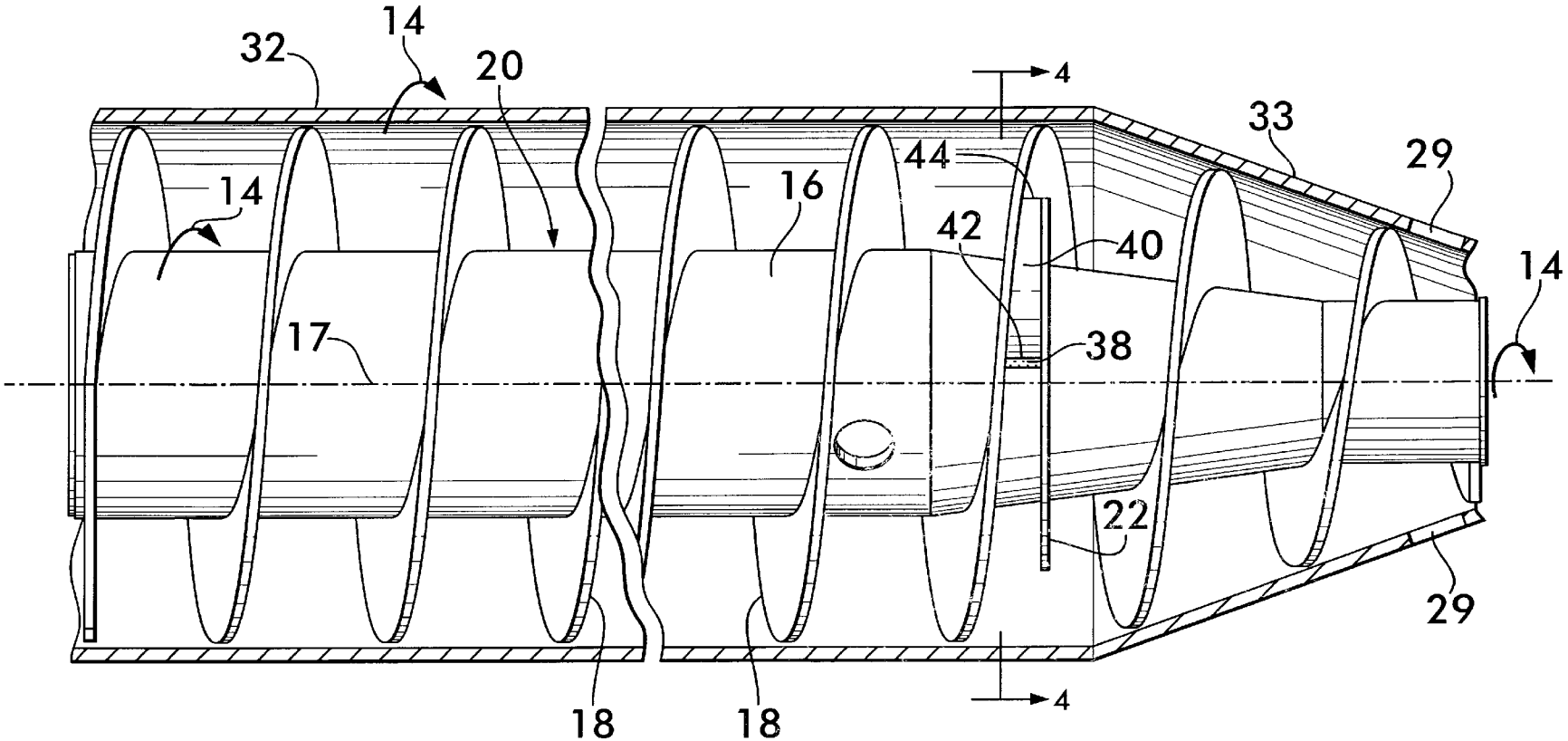
FIG. 3 illustrates a side sectional view of a decanter centrifuge incorporating the present invention.

In FIG. 3 there is shown an embodiment of the present invention. An imperforate centrifuge bowl 32 is shown in cross section, coaxially mounted with a conveyor 20 about longitudinal axis 17. A substantially hollow conveyor hub 16 extends the length of the bowl 32. A spiraled conveyor flight 18 is mounted to the conveyor hub 16 and extends to a position adjacent the inside surface of the bowl 32. A frusto-conical bowl portion 33 is provided with heavy phase discharge openings 29 at the restricted end thereof. Projecting from the hub 16 is a disc type baffle 22. The bowl 32 and conveyor 20 in the embodiment shown rotate in the clockwise direction 14 (as seen along the axis 17 when viewed from the right hand or solids discharge 29 end), with the bowl rotating slightly faster than the conveyor. The liquid discharge is contemplated to be positioned at the left end of the bowl, although such has not been illustrated in this FIG. 3. It is noted, however, that other constructions of the conveyor, bowl and baffle are known and contemplated.

Figure 4:
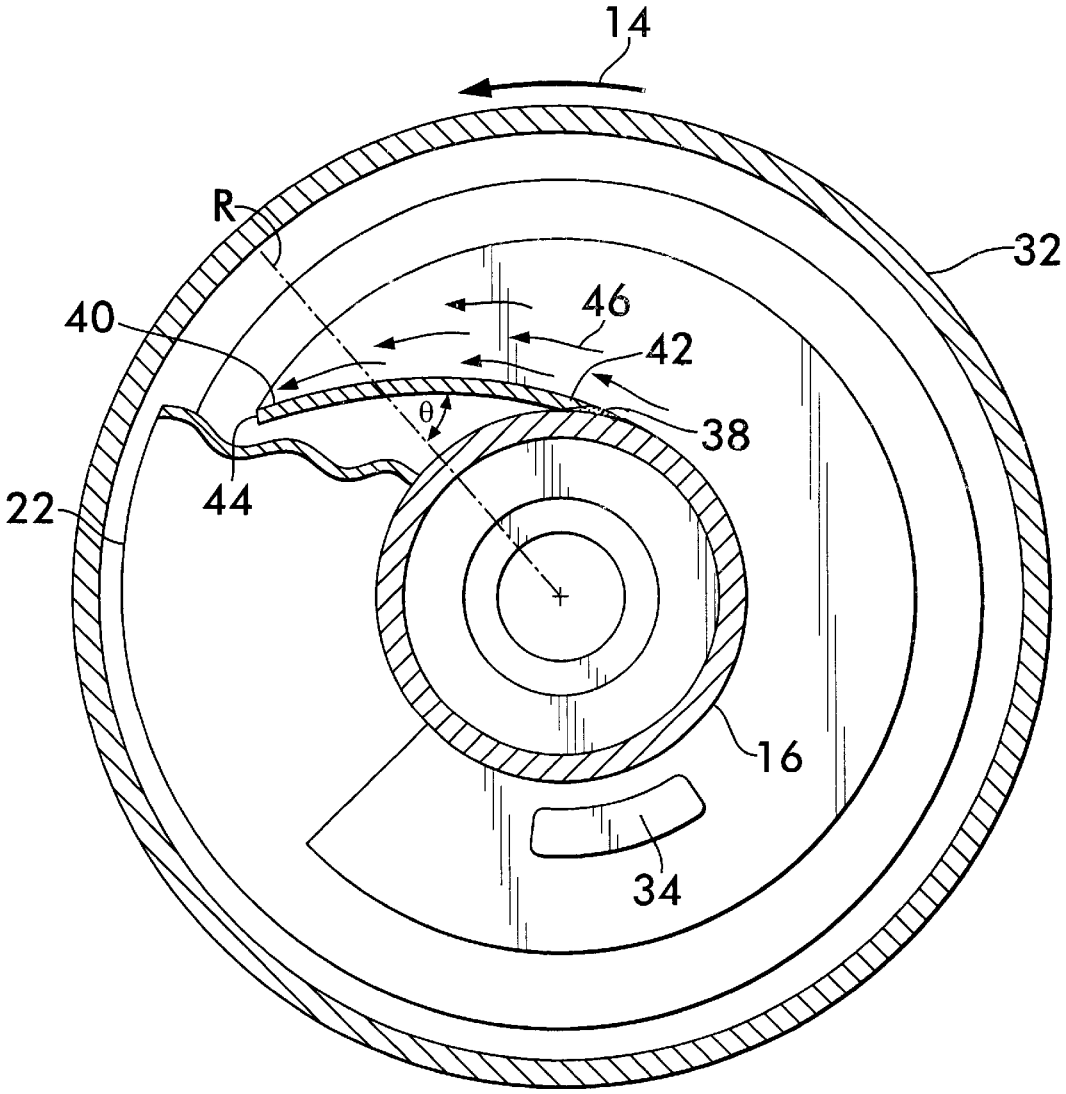
FIG. 4 is partial cross-sectional view of a decanter centrifuge incorporating the present invention as taken along line 4—4 in FIG. 3.

The shelf 40 in this embodiment, which is more clearly shown in FIG. 4, is curved. The radially inward end 42 is attached to the conveyor hub 16 by weld 38 and the radially outward edge 44 is positioned adjacent the radial periphery of the disc 22. The curvature of the shelf 40 is convex and essentially faces radially outward. Preferably, the curvature extends over a major portion of the shelf. The included angle θ between a radial line R and any point on the shelf 40 is greater than 45 degrees, and preferably in the range of 60 to 75 degrees. This allows the heavy phase solids to move under the shelf 40, as shown by arrows 46, while still maintaining the hydraulic seal. The shelf 40 is attached to both the face of flight 18 and the face of disc 22, preventing the flight and shelf from spreading apart.

Although the embodiment illustrated in FIGS. 3 and 4 includes a curved shelf 40, it is contemplated that other forms may be utilized. Alternatively, the shelf could be a relatively straight plate or have one or more steps, bends, or curved portions thereon. In each or these alternatives it is contemplated that the angle θ along a major portion of the shelf—particularly in the area adjacent the projected edge—will attain an angle greater than 45 degrees. This angle will provide a sufficient restriction for creation of the hydraulic seal with the heavy phase solids, letting only the driest solids under the baffle, without forming a solids jam.

Figure 5:
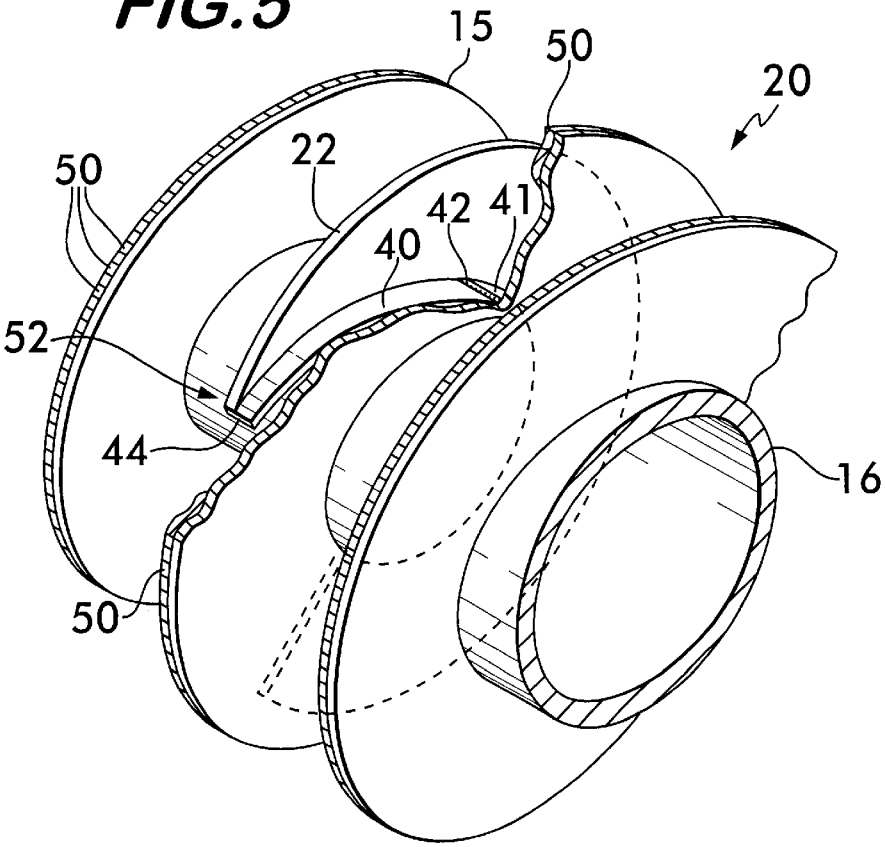
FIG. 5 shows a portion of a decanter centrifuge having the present invention thereon.

In the embodiment shown in FIG. 5, the forward or conveying face of the conveyor flight 18 is provided with a series of tiles 50. The tiles are typically applied for the purpose of providing a hard surface for the distal edge of the conveyor flight as taught by Brautigam U.S. Pat. No. 3,764,062 and Shapiro U.S. Pat. No. 4,328,925. As illustrated the tiles 50 include a concave plough shaped conveying surface such as that in Caldwell U.S. Pat. No. 4,449,967. Plough tiles are intended to turn the heavy phase solids so that the relatively drier material is moved radially inward, releasing more liquid from the heavy phase in the process.

Because of the tiles 50 on the conveyor flight 18, the distal end 44 of the shelf 40 may create a restriction at the junction 50 with the conveyor flight, if it is not of sufficient width. This potential problem can be addressed by replacing the plough tiles with flat tiles in the area of the disc 22, or leaving the width of the shelf 44 wide enough to avoid an axial restriction with the tiles. The disc would terminate at position 52 instead of continuing to position 50.

Figure 6:
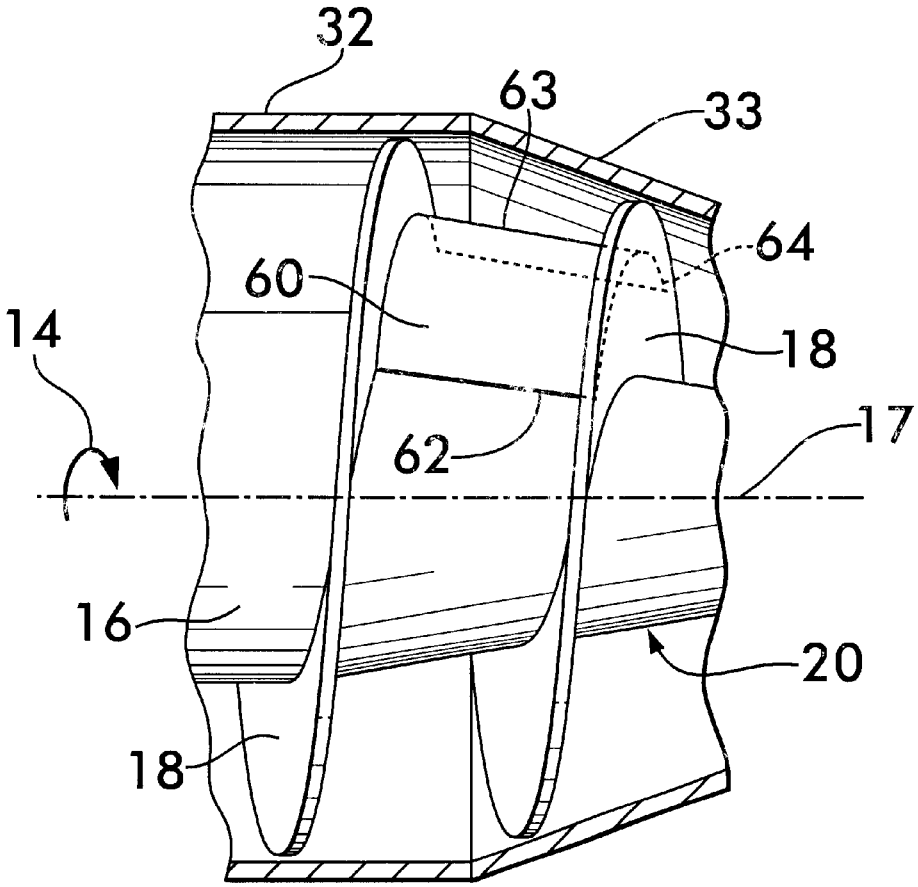
FIG. 6 shows a portion of a decanter centrifuge having thereon an alternate embodiment of the present invention.

In the above embodiments, reference has been made to a radial type baffle, in the form of a disc, cone or the like. An alternative embodiment could be formed using an axial type baffle, such as that contemplated by U.S. Pat. No. 3,934,792. As illustrated in FIG. 6, the axial baffle is formed by the shelf 60. The shelf 60 extends axially between adjacent portions of the conveyor flight 18. The radially inward edge 62 of the baffle 60 is attached to the conveyor hub 16. The baffle 60 forms a convex curve away from the hub 16 and has a radially outer peripheral edge 63 positioned inward of the bowl wall 32, 33 and the projected edge of the conveyor flight 18. The baffle 60 may continue to curve 64 beyond the peripheral edge 63, moving radially inwardly. The restriction by the baffle is formed at the projected edge 63. The largest width of the shelf 60 would be equal to the pitch of the conveyor flight. Alternatively, the shelf could extend axially a portion of the distance between the conveyor flights with an additional radial extension being formed by either a radial disc (not shown), or portion thereof, projected from the outer surface of the shelf or an axial plate (also not shown) extending from the peripheral edge of the shelf.

As illustrated in FIG. 6, the shelf 60 has a peripheral edge 63 which is substantially parallel to the inside wall of the frusto-conical portion 33 of the bowl. Alternatively, the shelf may be arranged parallel to the axis 17 or at any angle which will form a restriction for the heavy phase. Also, the peripheral edge of the shelf may extend between adjacent portions of the conveyor flight in a direction other than axially along the centrifuge.

For all of the embodiments, a counterweight 34 may be provided on the baffle or conveyor hub opposite the shelf. The center of gravity of the counterweight is contemplated to be opposite that of the shelf, and essentially at the same radius, so that the conveyor will remain balanced in both wet and dry operation.

The present invention may be embodied in other specific forms without departing from the spirit or essential attributes thereof, and accordingly, reference should be made to the appended claims, rather than to the foregoing specification, as indicating the scope of the invention.

What is claimed is:

1. In a centrifuge type having a rotatable screw conveyor therein, the screw conveyor comprising:

a central, longitudinally-extending hub;

a conveyor flight forming a spiral along at least a portion of the length of the hub;

a radially extending disc extending from the central hub to a position relatively inward of the conveyor flight; and a shelf extending across an offset area between the disc and a portion of the conveyor flight, the shelf further extending from a radial inward position to a position adjacent the distal edge of the disc and the shelf forming a surface along its length having an included angle with a radially extending line that is greater than 45 degrees when viewed through a cross section of the shelf in a plane parallel to the disc.

2. A centrifuge screw conveyor as claimed in claim 1 wherein the shelf extends from the central hub to the distal edge of the disc.

3. A centrifuge screw conveyor as claimed in claim 1 wherein the shelf extends from the central hub terminating some distance from distal edge of the disc.

4. A centrifuge screw conveyor as claimed in claim 1 wherein the included angle of the shelf falls within the range of 60 to 75 degrees.

5. A centrifuge screw conveyor as claimed in claim 1 wherein at least a portion of the shelf is curved.

6. A centrifuge conveyor as claimed in claim 1 wherein the distal end of at least a portion of the conveyor flight includes a series of conveying tiles mounted on its peripheral edge.

7. A centrifuge conveyor as claimed in claim 6 wherein the tiles include a concave plough shaped surface.

8. A centrifuge for separating a heavy phase material from a liquid within a feed mixture, the centrifuge comprising:

(a) a bowl rotatable about its longitudinal axis for separation of the heavy phase material from the feed mixture due to centrifugal force, the bowl comprising a cylindrical portion and a frusto-conical portion at one end, a heavy phase discharge provided in the restricted end of the frusto-conical bowl portion;

(b) a screw conveyor coaxially mounted for rotation within the bowl, the conveyor having a spiraled conveyor flight extending along its length from a central hub and having a distal edge positioned adjacent the inside wall of the bowl, the conveyor adapted to rotate at a relative speed with respect to the bowl for conveying separated heavy phase material along the inside bowl wall toward the heavy phase discharge;

(c) a disc extending from the central hub at a position in proximity to the connection of the cylindrical bowl portion and the frusto conical bowl portion, a first face of the disc facing in the direction opposite of the heavy phase discharge, the disc extending radially outwardly from the hub and having a peripheral edge positioned radially inward of the distal edge of the conveyor flight, the disc adapted to project into the separated heavy phase material being conveyed along the bowl wall toward the heavy phase discharge; and (d) a shelf extending between the first phase of the disc and a portion of the conveyor flight, the shelf further extending outwardly from the central hub of the conveyor toward the peripheral edge of the disc along the first face of the disc, the outer surface of the shelf forming along its length an included angle with a radially extending line that is greater than 45 degrees.

9. A separator as claimed in claim 8 wherein the bowl is substantially imperforate along its length.

10. A centrifuge screw conveyor as claimed in claim 8 wherein the included angle of the shelf falls within the range of 60 to 75 degrees.

11. A centrifuge screw conveyor as claimed in claim 8 wherein at least a portion of the shelf has a convex curvature.

12. A centrifuge conveyor as claimed in claim 8 wherein the distal end of at least a portion of the conveyor flight includes a series of conveying tiles.

13. A centrifuge conveyor as claimed in claim 12 wherein the tiles include a concave plough shaped surface.

14. A screw conveyor for use within a decanter centrifuge for separating a heavy phase material from a liquid within a feed mixture and conveying the separated heavy phase material towards a heavy phase discharge, the centrifuge conveyor comprising:

an elongated hub extending along a longitudinal axis and adapted for rotation around said axis;

a conveyor flight projecting radially outwardly from the hub and forming a spiral along at least a portion of the length of the hub;

a radially extending generally planar baffle attached to the central hub and projecting from a position on the central hub to a position relatively inward of the peripheral end of the conveyor flight, the baffle having two substantially flat faces, the first flat face facing the direction of the heavy phase discharge and the second face facing away from the heavy phase discharge;

a shelf extending along the second face of the disc between the baffle and a conveying portion of the conveyor flight, the shelf extending radially outwardly from a position adjacent the hub and having a convex curvature that projects outwardly from the conveyor hub to a position adjacent the peripheral edge of the baffle.

15. A centrifuge screw conveyor as claimed in claim 14 wherein at least a major portion of the shelf forms an included angle with a radially extending line that is greater than 45 degrees.

16. A centrifuge screw conveyor as claimed in claim 15 wherein the included angle of the shelf falls within the range of 60 to 75 degrees.

17. A centrifuge conveyor as claimed in claim 15 having plough shaped tiles formed on the conveyor flight.

18. A centrifuge conveyor as claimed in claim 14 wherein the distal end of at least a portion of the conveyor flight includes a series of conveying tiles.

19. A centrifuge conveyor as claimed in claim 18 wherein the tiles include a concave plough shaped surface.

20. A centrifuge for separating a heavy phase material from a liquid within a feed mixture, the centrifuge comprising:

a bowl rotatable about its longitudinal axis for separation of the heavy phase material from the feed mixture due to centrifugal force, the bowl comprising a cylindrical portion and a frusto-conical portion at one end, a heavy phase discharge provided in the restricted end of the frusto-conical bowl portion;

a screw conveyor coaxially mounted for rotation within the bowl, the conveyor having a spiraled conveyor flight extending along at least a portion of its length and having a distal edge positioned adjacent the inside wall of the bowl, the conveyor adapted to rotate at a relative speed with respect to the bowl for conveying separated heavy phase material along the inside bowl wall toward the heavy phase discharge;

a baffle extending continuously from a position adjacent the central hub to a peripheral edge positioned radially inward of the distal edge of the conveyor flight, the baffle defining a surface having a radially outwardly facing convex curvature adapted to project into the separated heavy phase material conveyed along the bowl wall, the baffle bridging axially offset portions of the conveyor flight and forming along its radial extension from its position adjacent the conveyor hub an included angle with a radially extending line that is greater than about 45 degrees.

21. A centrifuge as claimed in claim 20 wherein the included angle of the baffle falls within the range of 60 to 75 degrees.

22. A centrifuge as claimed in claim 20 wherein the peripheral edge of the baffle is positioned axially along the centrifuge conveyor.

23. A centrifuge as claimed in claim 20 wherein the baffle has an outwardly directed convex curvature along at least a substantial portion of its projected length.

24. A centrifuge for separating a heavy phase material from a liquid within a feed mixture, the centrifuge comprising:

a bowl rotatable about its longitudinal axis for separation of the heavy phase material from the feed mixture due to centrifugal force, the bowl comprising a cylindrical portion and a frusto-conical portion at one end, a heavy phase discharge provided in the restricted end of the frusto-conical bowl portion;

a screw conveyor coaxially mounted for rotation within the bowl, the conveyor having a spiraled conveyor flight extending along at least a portion of its length and having a distal edge positioned adjacent the inside wall of the bowl, the conveyor adapted to rotate at a relative speed with respect to the bowl for conveying separated heavy phase material along the inside bowl wall toward the heavy phase discharge;

a baffle attached to the central hub at one end and extending continuously from the hub to a peripheral edge positioned radially inward of the distal edge of the conveyor flight, the baffle adapted to project into the separated heavy phase material conveyed along the bowl wall by the conveyor flight, the baffle bridging adjacent portions of the conveyor flight and defining a surface having an outwardly directed convex curvature along at least a substantial portion of its peripheral length.

25. A centrifuge as claimed in claim 24 wherein the baffle forms along its radial extension from the conveyor hub to its peripheral edge an included angle with a radially extending line that is greater than 45 degrees.

26. A centrifuge as claimed in claim 25 wherein the included angle of the baffle falls within the range of 60 to 75 degrees.

* * * * *